US006752659B2

(12) United States Patent
Nakamura et al.

(10) Patent No.: US 6,752,659 B2
(45) Date of Patent: Jun. 22, 2004

(54) WATERPROOF CONNECTOR

(75) Inventors: Mitsuharu Nakamura, Shizuoka-ken (JP); Teruo Yokota, Shizuoka-ken (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 10/078,361

(22) Filed: Feb. 21, 2002

(65) Prior Publication Data

US 2002/0115345 A1 Aug. 22, 2002

(30) Foreign Application Priority Data

Feb. 22, 2001 (JP) ..... P2001-046934

(51) Int. Cl.[7] ..... H01R 13/40
(52) U.S. Cl. ..... 439/587; 439/275; 439/279
(58) Field of Search ..... 439/587, 588, 439/271, 274, 275, 279

(56) References Cited

U.S. PATENT DOCUMENTS 5,451,717 A * 9/1995 Itou ..... 174/74 R
5,482,299 A * 1/1996 Saito ..... 277/604
5,645,451 A * 7/1997 Ohsumi et al. ..... 277/637
5,667,406 A * 9/1997 Tabata et al. ..... 439/587
5,720,487 A * 2/1998 Kato ..... 277/637
5,720,629 A * 2/1998 Self et al. ..... 439/274
6,217,394 B1 * 4/2001 Sugie ..... 439/587
6,332,797 B1 * 12/2001 Taguchi et al. ..... 439/275
6,341,984 B1 * 1/2002 Murakami et al. ..... 439/587
6,383,021 B1 * 5/2002 Murakami et al. ..... 439/489

* cited by examiner

*Primary Examiner*—P. Austin Bradley
*Assistant Examiner*—Edwin A. León
(74) *Attorney, Agent, or Firm*—Finnegan, Henderson, Farabow, Garrett & Dunner, L.L.P.

(57) ABSTRACT

A waterproof connector is provided with a connector housing having a mating hollow to which an opposing connector is fitted, a seal fitted to an opposite side to the mating hollow of the connector housing, and a rear holder inserted and fitted to the connector housing. The seal is further provided with a plurality of through holes to which cables provided with terminals at front ends are respectively inserted, and the rear holder is provided with insertion holes communicating with the through holes respectively. The rear holder allows the cable to pass through at a time of being inserted to a temporary engaging position, and presses the seal so as to fix at a time of being inserted to a regular engaging position. The insertion holes are extended so as to have a length at a degree at which a front end thereof is not brought into contact with lips of the through holes even when the inserted terminals are inclined. Any one or both of the connector housing and the rear holder is provided with one or more ribs sliding pressure contact with an opposing member, and the rib extends in a fitting and inserting direction of the rear holder.

3 Claims, 4 Drawing Sheets

63c
72
30
63a
62
63
70a
70
73
31
25
70b
71
L
25b
25a
IIB
20a
20
20b
10
63a
72
62
60
63
61
22
63b
24a
24
52
34
50
23
51
51a
41a
21
41
40
δ

WATERPROOF CONNECTOR

BACKGROUND OF THE INVENTION

1. Field of the Invention

The present invention relates to a waterproof connector for waterproofing a terminal and a cable on the basis of sealing.

2. Description of the Related Art

A conventional waterproof connector is provided with a terminal housing in an inner portion of a connector housing, a mating hollow to which an opposing connector is fitted in a forward portion thereof, and a seal fitted to the terminal housing in a rearward portion thereof. The seal is provided with a plurality of through holes to which cables provided with terminals at front ends are respectively inserted. A rear holder is further inserted to a rear portion thereof, whereby the seal is fixed, and the cables and the terminals are waterproofed.

SUMMARY OF THE INVENTION

In the conventional waterproof connector, when the terminals are inserted from the rearward portion, the terminals pass through an insertion holes of the rear holder and reach the through holes in the seal. At this time, since no means for suitably guiding the terminals is provided, there is a disadvantage that the terminals abut lips of the through holes at a time when the terminals reach the seal in the case that the terminals are inserted in an inclined manner. Accordingly, an assembling operation hardens, the front ends of the terminal injure the seal, and in some cases, a sealing property is deteriorated due to the injury.

The present invention is made by taking the problems in the conventional waterproof connector into consideration, and an object of the present invention is to provide a waterproof connector in which a length of the terminal insertion holes in a rear holder is necessarily and sufficiently set so as to restrict an incline of terminals, whereby front ends of the terminals are smoothly inserted to through holes of a packing.

The waterproof connector according to the present invention is provided with a connector housing having a mating hollow to which an opposing connector is fitted, a seal fitted to an opposite side to the mating hollow of the connector housing, and a rear holder inserted and fitted to the connector housing. The seal is further provided with a plurality of through holes to which cables provided with terminals at front ends are respectively inserted, and the rear holder is provided with insertion holes communicating with the through holes respectively. The rear holder allows the cable to pass through at a time of being inserted to a temporary engaging position, and presses the seal so as to fix at a time of being inserted to a regular engaging position. The insertion holes are extended so as to have a length at a degree at which a front end thereof is not brought into contact with lips of the through holes even when the inserted terminals are inclined. Any one or both of the connector housing and the rear holder is provided with one or more ribs sliding pressure contact with an opposing member, and the rib extends in a fitting and inserting direction of the rear holder.

The terminal is inserted to the insertion hole provided in the rear holder in a state of setting the rear holder at the temporary engaging position. Since the insertion hole has a sufficient length, the insertion hole restricts an incline of the inserted terminals. Accordingly, it is possible to prevent the front ends of the terminal from striking the ports of the through holes at a time when the front ends of the terminal reach the seal, thereby being smoothly guided to the through holes.

Since the ribs protruded from one of the connector housing and the rear holder is pressure contacted with another at a time of inserting and fitting the rear holder to the connector housing, the ribs prevent the rear holder from being bumpy, and further it is possible to prevent the terminal inserted to the terminal insertion hole in the rear holder from being widely inclined with respect to the seal. Further, since the ribs are continuously provided in the inserting direction of the rear holder, it is possible to smoothen the insert thereof.

BRIEF DESCRIPTION OF THE DRAWINGS

FIG. 2A is a cross sectional view of a waterproof connector according to the embodiment of the present invention, in which a slide is in a state of allowing the terminal to pass through;

FIG. 2B is a cross sectional view in which a portion shown by a section IIB in FIG. 2A is enlarged in the waterproof connector according to the embodiment of the present invention;

DETAILED DESCRIPTION OF THE PREFERRED EMBODIMENT

A description will be in detail given below of an embodiment according to the present invention with reference to the accompanying drawings.

Figure 1:
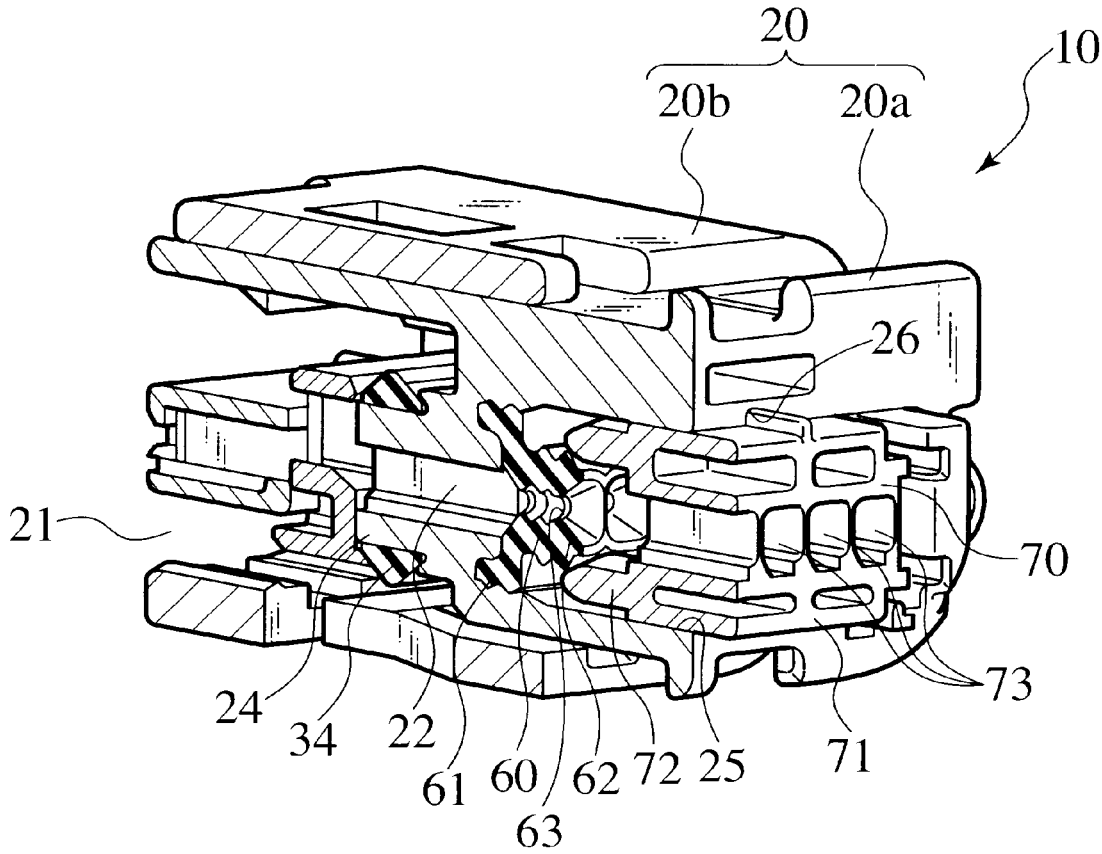
FIG. 1 is a cross sectional perspective view of a main portion of a waterproof connector according to an embodiment of the present invention, in which a rear holder is in a temporary engaging state.
Figures 2A, 2B:
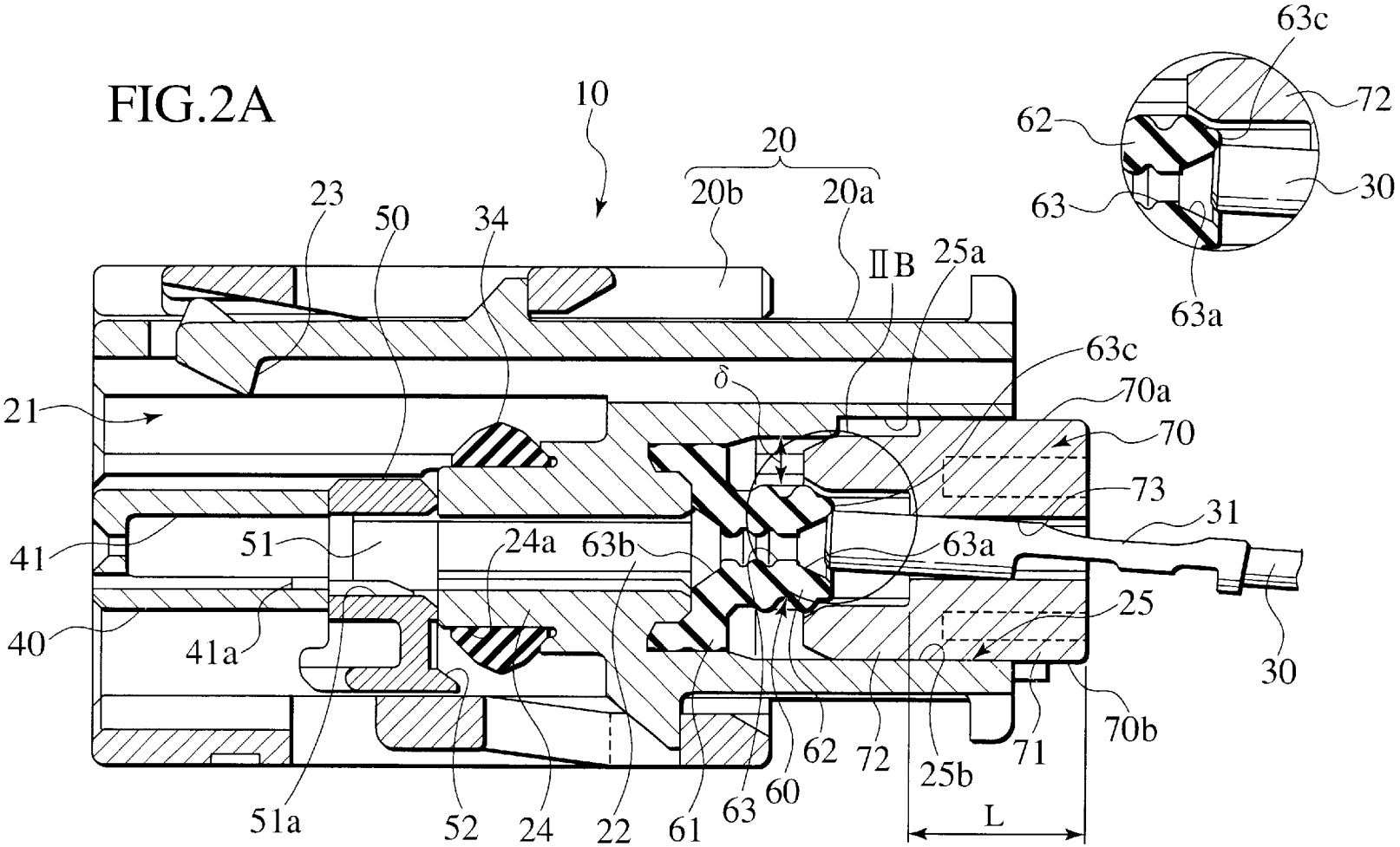
Figure 3:
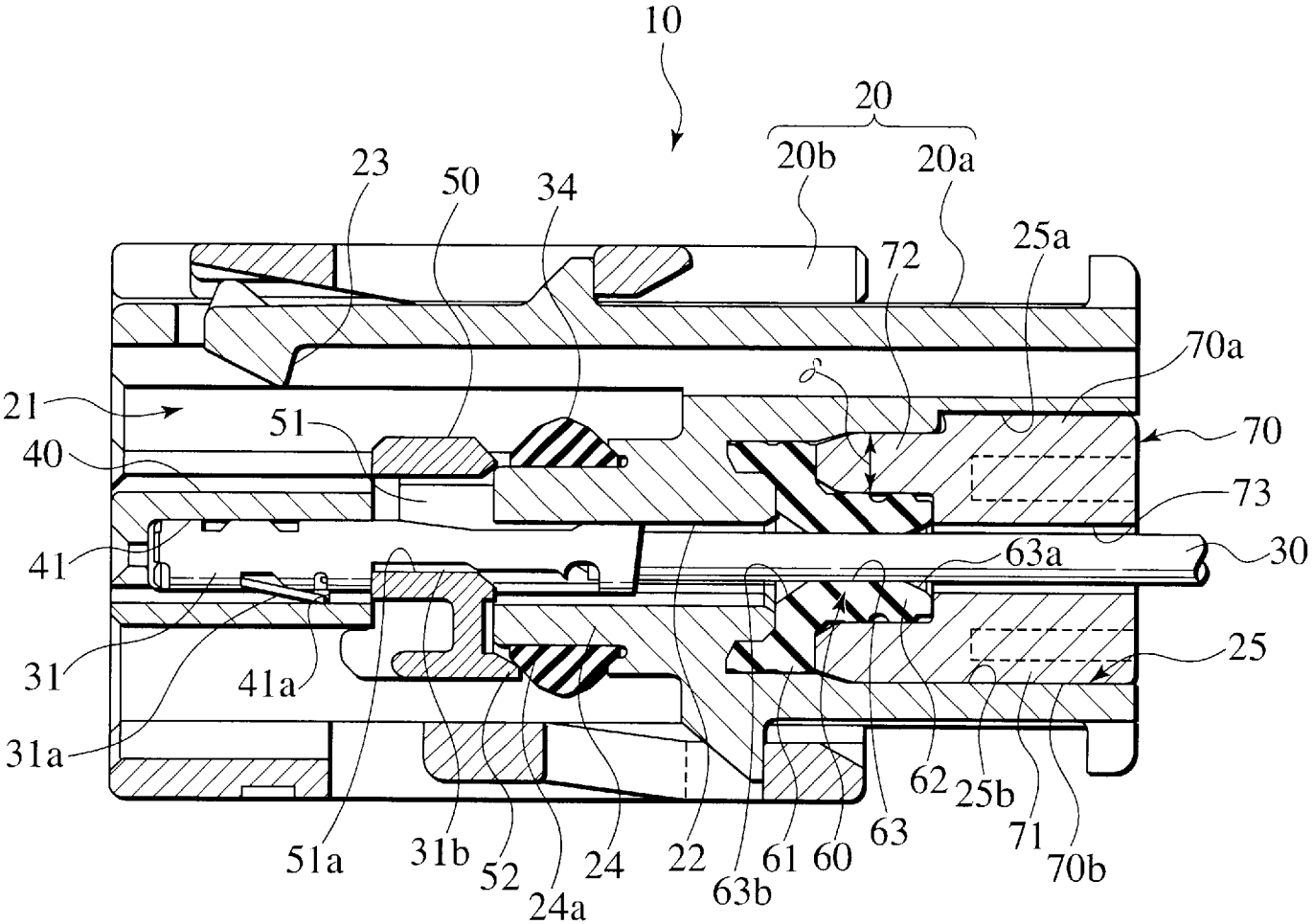
FIG. 3 is across sectional view of the waterproof connector according to the embodiment of the present invention, in which the rear holder is in a regular engaging state.

A waterproof connector 10 according to the present embodiment is provided with a connector housing 20 constituted by an inner housing 20*a* and an outer housing 20*b*, as shown in FIGS. 1 to 3, and a mating hollow 21 of an opposing connector (not shown) is open to a front end side (a left side in the drawing) of the connector housing 20. Guiding slots 22 to which cables 30 are inserted are formed in a center portion of the connector housing 20 from a base end side (a right side in the drawing) toward a front end side as shown in FIG. 3, and terminals 31 connected to front end portions of the cables 30 are inserted to the guiding slits 22. At this time, a housing recess 25 for fitting and inserting a seal 60 and a rear holder 70 fixing the seal 60 is formed in a base end side of the connector housing 20.

The outer housing 20*b* is movably fitted to an outer side of the inner housing 20*a*, and the outer housing 20*b* moves to the front end side of the connector housing 20, thereby pressing down a hook 23 of the inner housing 20*a* so as to engage with the opposing connector. A tubular block 24 forming the guiding slots in a center portion and protruding within the mating hollow 21 is protruded from the inner housing 20*a*, and a first packing 34 having a semicircular cross sectional shape is fitted to a thinner portion 24*a* formed in an outer periphery of the tubular block 24.

The terminal 31 is structured, as shown in FIG. 3, such that one end portion is positioned within the tubular block 24, that is, within the guiding slot 22 of the tubular block 24 and another end portion is protruded from the tubular block 24 toward the front end side of the connector housing 20, and the protruded front end portion is received and held within a cavity 41 of a terminal housing 40. In the present embodiment, in view of a connection that a plurality of cables 30 and corresponding terminals 31 are provided, the cavities 41 are provided so as to correspond to the number of the terminals 31.

Lance 31*a* inclined in a direction in which a base end side (a right side in the drawing) protrudes are provided in a portion in which the terminals 31 are received in the cavities 41, and the lances 31*a* are engaged with engaging abutments 41*a* within the cavities 41, whereby the terminals 31 are prevented from coming off. At this time, the terminal housing 40 received within the mating hollow 21 is structured such that a front end surface is arranged substantially on the same surface as the front end of the connector housing 20.

A slide 50 is arranged between the terminal housing 40 and the packing 34, in detail, between the terminal housing 40 and the tubular block 24 fitting the packing 34. In this slide 50, there are formed slits 51 to which the terminals 31 are inserted, and extending in a vertical direction to a longitudinal direction of the terminals 31. Then, as shown in FIG. 2, the structure is made such that the terminals 31 can pass through in a state that the slide 50 moves downward in a lower portion in the drawing, and as shown in FIG. 3, lower halves 51*a* of the slits 51 are engaged with recesses 31*b* of the terminals 31 in a state that the slide 50 is pressed upward in the drawing, thereby preventing the terminals 31 from coming off. At this time, the lower halves 51*a* of the slide 50 and the lances 31*a* construct a double engagement structure. Further, a retaining portion 52 pressing an outer side in a front end side (a left side in the drawing) of the packing 34 so as to prevent the packing 34 from coming off is provided in the slide 50.

The seal 60 is made of a rubber, and is provided with a trunk portion 61 pressure contacted with an inner periphery of the housing recess 25 and a neck portion 62 having a predetermined clearance d between the neck portion 62 and the inner periphery of the housing recess 25, and annular uneven portions for increasing a closely contact property are formed in respective outer peripheries of the trunk portion 61 and the neck portion 62. Then, through holes 63 of the cables 30 are formed in a center portion of the seal 60, and first and second conical surfaces 63*a* and 63*b* are formed in both end portions of the through holes 63. Further, annular uneven portions are formed in inner peripheries of the through holes 63 for increasing a closely contact property with the cables 30.

Figure 4:
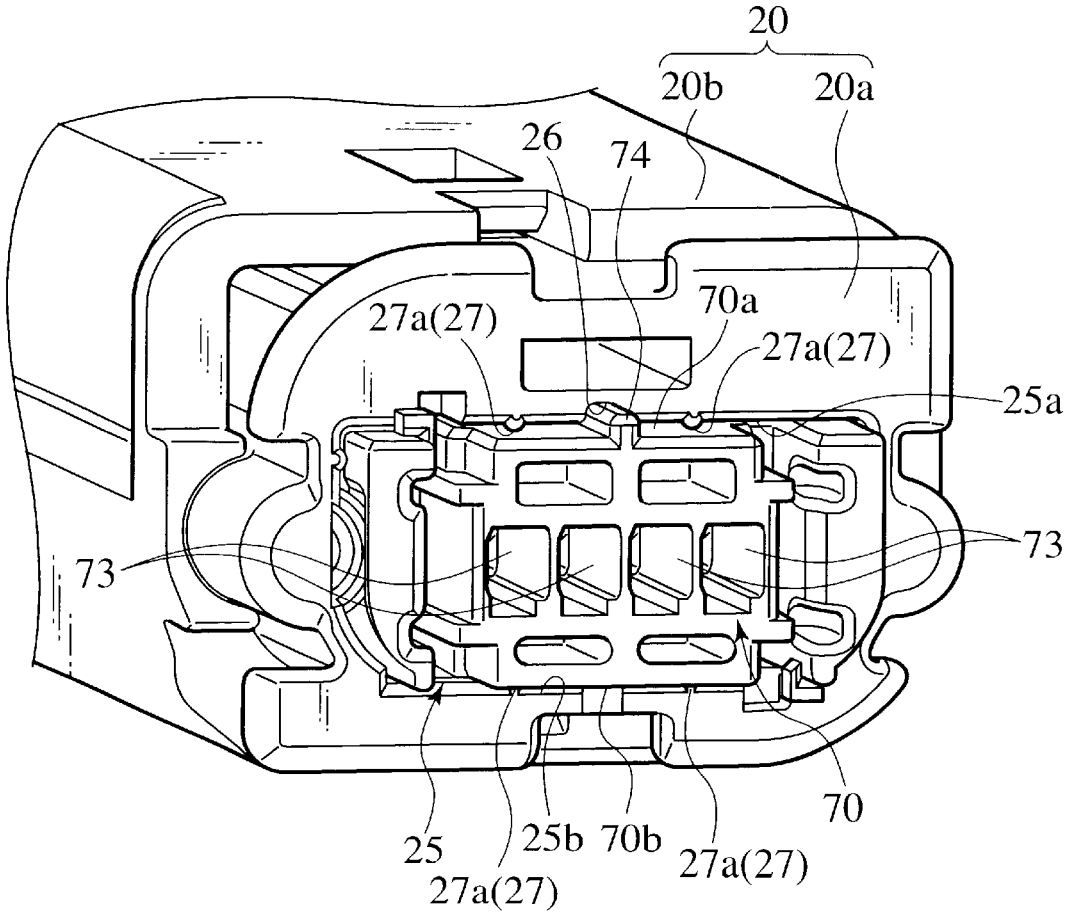
FIG. 4 is a perspective view, in which a portion fitted to the rear holder is enlarged, in the waterproof connector according to the embodiment of the present invention.

The rear holder 70 is provided with a main body 71 formed substantially along the inner periphery of the housing recess 25, as shown in FIG. 4, and a wedging protrusion 72 protruded from a front end portion of the main body 71 and pressure inserted to a clearance d between the neck portion 62 of the seal 60 and the housing recess 25, as shown in FIG. 3. Further, the wedging protrusion 72 is pressure inserted to the clearance d, whereby the neck portion 62 is wholly compressed so as to press and compress the through holes 63, thereby increasing a closely contacting force with the cables 30, so that a state before the wedging protrusion 72 is inserted to the clearance d becomes the temporary engaging position of the rear holder 70 as shown in FIG. 2, and a state that the wedging protrusion 72 is completely inserted to the clearance d becomes the regular engaging state as shown in FIG. 3.

Insertion holes 73 communicated with the through holes 63 of the seal 60 are formed in a center portion of the rear holder 70. The insertion holes 73 are formed so as to have such a diameter as to be capable of passing through the terminals 31. Further, as shown in FIG. 4, a guiding rib 74 extending in an inserting direction of the rear holder 70 is protruded from a center portion of an upper surface in the main body 71, whereby the guiding rib 74 is fitted to a slot 26 of the housing recess 25 so as to be guided. Further, a pair of ribs 27 sliding pressure contacted with upper and lower both surfaces 70*a* and 70*b* of the rear holder 70 are respectively provided on upper and lower both inner surfaces 25*a* and 25*b* of the housing recess 25 in a symmetrical manner. These ribs 27 are continuously provided in a fitting and inserting direction of the rear holder 70.

Further, as shown in FIG. 2, the structure is made such that the terminals 31 connected to the front end portion of the cables 30 are inserted to the through holes 63 of the seal 60 from the insertion holes 73 in a state of setting the rear holder 70 at the temporary engaging position, and thereafter the rear holder 70 is fitted and inserted to the regular engaging position after completely inserting the cables 30, as shown in FIG. 3. In this state, the seal 60 holds the cables 30 in a liquid tight manner.

In this case, according to the present embodiment, as shown in FIG. 2A, a length L of the insertion holes 73 is extended so that the front ends of the terminal 31 inclined at a time of being inserted to the insertion holes 73 are within a range of incline at which the front ends of the terminals 31 are not interfered with lips 63*c* of the through holes 63 in the seal 60, as shown in FIG. 2B.

According to the structure mentioned above, in the waterproof connector 10 of the present embodiment, in order to set the terminal 31 connected to the front end portions of the cables 30 to the waterproof connector 10, at first, as shown in FIG. 2A, in the state of setting the rear holder 70 at the temporary engaging position, whereby the wedging protrusion 72 does not compress the through holes 63 of the seal 60, the terminals 31 are inserted to the insertion holes 73. At this time, since the length L of the insertion holes 73 is extended so that the front ends of the terminals 31 inclined at a time of being inserted to the insertion holes 73 are within the range of incline at which the front ends of the terminals 31 are not interfered with the lips 63*c* of the through holes 63, the front ends of the terminals 31 inserted to the insertion holes 73 are guided to the through holes 63 of the seal 60, and the terminals 31 are smoothly inserted to the through holes 63. Accordingly, an inserting operability of the terminals 31 is improved, it is possible to prevent the peripheral edge portions of the through holes 63 in the seal 60 from being injured, and it is possible to secure a sealing property applied by the seal 60.

Further, according to the present embodiment, since the ribs 27 provided in the upper and lower both inner surfaces 25*a* and 25*b* of the housing recess 25 in the connector housing 20 are structured such as to be sliding pressure contacted with the upper and lower both surfaces 70*a* and 70*b* of the rear holder 70, it is possible to prevent the rear holder 70 from being bumpy in the state of being fitted and inserted to the housing recess 25, and further it is possible to prevent the terminals 31 inserted to the insertion holes 73 from being largely inclined with respect to the seal 60. Accordingly, it is possible to prevent the front ends of the terminals 31 from being interfered with the lips 63*c* of the through holes 63 due to the bumpy motion of the rear holder 70.

Further, in this case, since the ribs 27 are continuously provided in the fitting and inserting direction of the rear holder 70, it is possible to smoothly fit and insert the rear holder 70 to the housing recess 25, and further it is possible to improve an assembling property of the rear holder 70.

Although the invention has been described above by reference to certain embodiments of the invention, the invention is not limited to the embodiments described above. Modifications and variations of the embodiments described above will occur to those skilled in the art, in light of the above teachings.

What is claimed is:

1. A waterproof connector comprising:

a connector housing comprising a mating hollow mating with an opposing connector;

a seal comprising a plurality of through holes each accommodating a cable and terminal connected with an end of the cable and fitting to an opposite side to the mating hollow of the connector housing; and a rear holder inserted and fitted to the connector housing comprising a plurality of insertion holes communicating with the through holes respectively;

wherein the rear holder allows the cables to pass through in a case where the rear holder is inserted at a temporary engaging position and compresses the seal so as to fix the cables in a case where the rear holder is further inserted at a regular engaging position; and the insertion holes that have at least a portion of the insertion holes located prior to the through holes in the connector housing and that are extended an appropriate length so as to restrict end tips of the terminals to a range of incline angles at which the end tips of the terminals are restricted from interfering with lips of the through holes.

2. A waterproof connector according to claim 1, wherein:

either or both of the connector housing and the rear holder have one or more projections to be slidablly press-contact with the opposite member.

3. A waterproof connector according to claim 2, wherein:

the projections are ribs stretching in an inserting direction of the rear holder.

* * * * *

UNITED STATES PATENT AND TRADEMARK OFFICE

CERTIFICATE OF CORRECTION

PATENT NO. : 6,752,659 B2
DATED : June 22, 2004
INVENTOR(S) : Mitsuharu Nakamura It is certified that error appears in the above-identified patent and that said Letters Patent is hereby corrected as shown below:

Column 6,
Line 1, "holder allows" should read -- holder includes a wedging protrusion, which allows --.
Line 1, "through in" should read -- through the insertion holes in --.
Line 2, "rear holder" should read -- wedging protrusion --.
Line 3, "position and" should read -- position with the rear holder and --.
Line 4, "rear holder" should read -- wedging protrusion --.
Line 5, "position; and" should read -- position with the rear holder; and --.
Line 8, "an appropriate" should read -- a predetermined --.
Line 9, delete "so as".
Line 11, "lips" should read -- peripheral edge portions --.
Line 12, "holes." should read -- holes to prevent the peripheral edge portions from being damaged. --.
Line 15, "slidablly" should read -- slid into --.

Signed and Sealed this

Fifth Day of July, 2005

JON W. DUDAS
*Director of the United States Patent and Trademark Office*